United States Patent [19]

Kaneko et al.

[11] Patent Number: 4,971,942

[45] **Date of Patent: * Nov. 20, 1990**

[54] HEAT-SENSITIVE RECORDING MATERIAL

[75] Inventors: Toshio Kaneko; Toshiaki Minami; Tadakazu Fukuchi; Fumio Fujimura, all of Tokyo, Japan

[73] Assignee: Jujo Paper Co., Ltd., Tokyo, Japan

[ * ] Notice: The portion of the term of this patent subsequent to Aug. 1, 2006 has been disclaimed.

[21] Appl. No.: 298,124

[22] Filed: Jan. 17, 1989

[30] Foreign Application Priority Data

Jan. 20, 1988 [JP] Japan ..... 63-10451
Feb. 16, 1988 [JP] Japan ..... 63-33583

[51] Int. Cl.[5] ..... B41M 5/18

[52] U.S. Cl. ..... 503/217; 427/151; 503/204; 503/209; 503/216; 503/220; 503/221

[58] Field of Search ..... 427/150–152; 428/913, 914; 503/204, 209, 216, 217, 220, 221

[56] References Cited

U.S. PATENT DOCUMENTS 4,853,362 8/1989 Satake et al. ..... 503/209

*Primary Examiner*—Bruce H. Hess
*Attorney, Agent, or Firm*—Koda & Androlia

[57] ABSTRACT

A heat sensitive recording material having a support and a color-developing layer which comprises both as a colorless basic chromogenic dye at least one of a particular fluorane-type leuco dye and a particular divinyl compound, the heat-sensitive recording material of this invention having superior thermal responsibility, light resistance, weather resistance, oil resistance and optical readability in the near infrared region.

8 Claims, No Drawings

HEAT-SENSITIVE RECORDING MATERIAL

BACKGROUND OF THE INVENTION

1. Field of the Invention

This invention relates to a heat-sensitive recording material which is superior in thermal responsibility light resistance, weather resistance, oil resistance, and optical readability in the near infrared region.

2. Prior Art

In general, a heat-sensitive recording sheet is produced by applying a support, such as paper, synthetic paper, film, plastic, etc., a coating which is prepared by individually grinding and dispersing a colorless chromogenic dyestuff and an organic color-developing agent, such a phenolic material, etc., into fine particles, mixing the resultant dispersion with each other and then adding thereto binder filler, sensitizer, slipping agent and other auxiliaries. The coating, when heated by thermal pen, thermal head, hot stamp, laser beam, etc., undergoes instantaneously a chemical reaction which forms a color. These heat-sensitive recording sheets have now been finding a wide range of applications, including industrial measurement recording instruments, terminal printers of computer, facsimile equipments, automatic ticket vending machines, printer for bar-code-label, and so on. In recent years, as the application of such recording is diversified and the performance of such recording equipment is enhanced, high qualities are required for heat-sensitive recording sheets. For example, even with small heat energy in a high speed recording, both the clear image with a high density and the better preservability such as better resistance to light, weather and oil, etc. are required. These heat-sensitive recording sheets are also utilized as thermosensitive labels. Since, however, color formation in these recording sheets is in the visible region, they cannot be adapted for reading by a semiconductor laser in the near infrared region which is widely used as a bar code scanner in a POS system, etc.

On the other hand, Japanese Laid-Open Patent Publication Nos. 59-199757 and 60-226871 disclose a heat-sensitive recording sheet containing a combination of a conventional color developing agent (phenol resin, hydroxybenzoate and bisphenol-A) and a fluorane-type leuco dyestuff having excellent color-developing ability in the near infrared region. Japanese Laid-Open Patent Publication Nos. 62-243652, 62-243653 and 62-257970 disclose a heat-sensitive recording sheet containing a combination of a conventional color developing agent and a divinyl compound having excellent color-developing ability in the near infrared region.

However, these heat-sensitive recording sheets have a remarkably inferior stability (inferior resistance to light, weather and oils) of the recorded image. Hence, in long storage under condition of exposure to light, moisture, etc., the recorded image is discolored, the image density is reduced, and sometimes the image disappears, which deteriorates a optical readability in near infrared region. By the adhesion of serum, or by contact with plasticizer (DOP, DOA etc.) in wraping film, such as vinyl chloride film, the image density is prominently lowered or the recorded image disappears, which causes a remarkable reduction of a optical readability in the near infrared region. In view of above defects, the practical use of these heat-sensitive recording sheets was difficult.

SUMMARY OF THE INVENTION

It is the object of this invention to provide a heat-sensitive recording material which is superior in optical readability in the near infrared region.

It is the another object of this invention to provide a heat-sensitive recording material which is better in thermal responsibility, light resistance, weather resistance and oil resistance.

It is the further object of this invention to provide a heat-sensitive recording material which is usable under severe conditions in bar-code-label, etc.

The above-mentioned objects can be performed as follows. The heat-sensitive recording material comprises a support having thereon a color-developing layer which comprises a fluorane-type leuco dye represented by the following general formula (I) and a divinyl compound represented by the following general formula (II), and optionally a fluorene-type leuco dye represented by the following general formula (III).

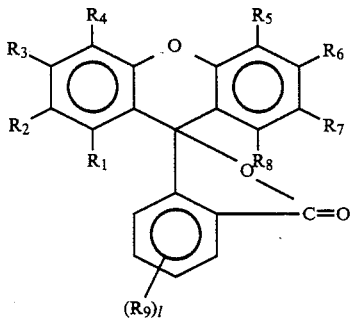

(I)

wherein at least one of $R_1$, $R_2$, $R_3$, $R_4$, $R_5$, $R_6$, $R_7$, $R_8$ and $R_9$ represents

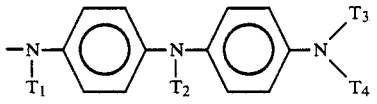

the remainders of R, $R_2$, $R_3$, $R_4$, $R_5$, $R_6$, $R_7$, $R_8$ and $R_9$, which may be the same or different, represent a hydrogen atom, an alkyl group, an alkoxy group, a cycloalkyl group, a halogen atom, a nitro group, a hydroxy group, an amino group, a substituted amino group, an aralkyl group, a substituted aralkyl group, an aryl group or a substituted aryl group;

$T_1$, $T_2$ and $T_3$, which may be the same or different, represent a hydrogen atom, a $C_1$-$C_8$ alkyl group, a $C_3$-$C_9$ alkenyl group, or a $C_3$-$C_9$ alkinyl group; $T_4$ represents a hydrogen atom, a $C_1$-$C_8$ alkyl group, a $C_3$-$C_9$ alkenyl group, a $C_3$-$C_9$ alkinyl group or a phenyl group; in addition, $T_3$ and $T_4$ taken together with the nitrogen to which they are attached, may represent, a morpholino group, a pyrrolidino group, a piperidino group or a hexamethyleneimino group; and l represents an integer from 0 to 4;

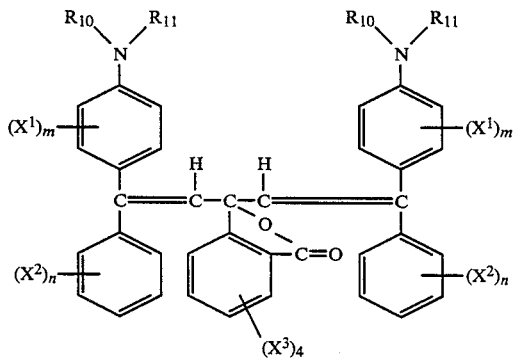

(II)

wherein $R_{10}$ represents an alkyl group of not more than 8 carbon atoms;

$R_{11}$ represents an alkyl group of not more than 8 carbon atoms, a $C_5$-$C_7$ cycloalkyl group, a benzyl group which may be substituted with a chlorine atom, a bromine atom and/or an alkyl group of not more than 4 carbon atoms, or a phenyl group which may be substituted with a chlorine atom, a bromine atom and/or an alkyl group of not more than 4 carbon atoms; $X^1$ and $X^2$, which may be the same or different, represent an alkyl group of not more than 8 carbon atoms, an alkoxy group of not more than 8 carbon atoms, a fluorine atom, a chlorine atom or a bromine atom;

m and n each represents 0, 1, 2 or 3;

each $X^1$ of $(X^1)_n$, each $X^2$ of $(X^2)_n$ or each $X^3$ of $(X^3)_n$ can be the same or different; and $X^3$ represents a chlorine atom or a bromine atom,

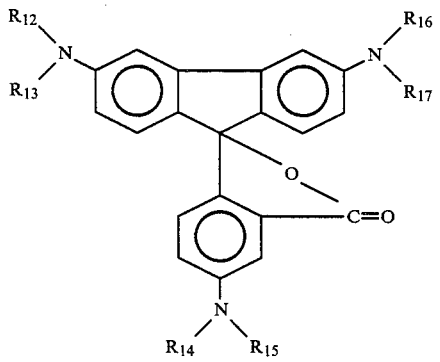

(III)

wherein $R_{12}$, $R_3$, $R_{14}$, $R_{15}$, $R_{16}$ and $R_{17}$, which may be the same or different, represent a hydrogen atom; a $C_1$-$C_8$ alkyl group; a $C_5$-$C_8$ cycloalkyl group; a $C_3$-$C_8$ alkoxyalkyl group; a $C_3$-$C_9$ unsaturated alkyl group; a tetrahydrofurfuryl group; a tetrahydropyran-2-methyl group; an alkyl group which may be substituted by a halogen atom, and/or a $C_1$-$C_4$ alkoxy group; an aryl group which may be substituted by a halogen atom, a $C_1$-$C_4$ alkyl group and/or a $C_1$-$C_4$ alkoxy group; a $C_2$-$C_8$ alkyl group having a phenoxy group which may be substituted by a halogen atom, a $C_1$-$C_4$ alkyl group and/or a $C_1$-$C_4$ alkoxy group; in addition, $R_{12}$ and $R_{13}$, $R_{14}$ and $R_{15}$, or $R_{16}$ and $R_{17}$ taken together with each other or with an attached benzene ring may form a heterocyclic ring.

Among the fluoranetype leuco dyes of the general formula (I), the dyes of the following general formula (IV) is preferable.

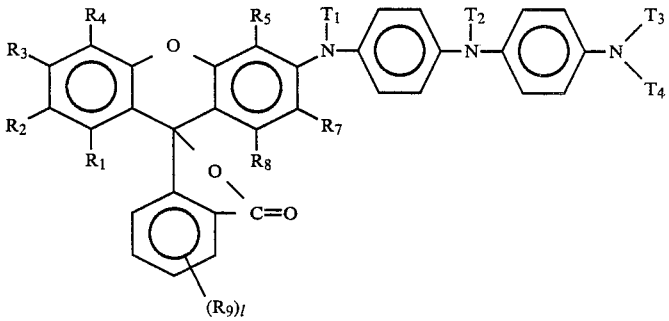

(IV)

wherein $R_1$, $R_2$, $R_3$, $R_4$, $R_5$, $R_6$, $R_7$, $R_8$, $R_9$, $T_1$, $T_2$, $T_3$, $T_4$ and l are as defined above.

The fluorane type leuco dyes of this invention are not particularly limited and include, for example, 2-methyl6-p-(p-dimethylaminophenyl)aminoanilinofluorane, 2methoxy-6-p-(p-dimethylaminophenyl-)aminoanilinofluorane, 2-chloro-6-p (p-dimethylaminophenyl) aminoanilinofluorane, 2-nitro-6-p-(p-diethylaminophenyl) aminoanilinofluorane, 2-amino-6-p-(p-diethylaminophenyl) aminoanilinofluorane, 2-diethylamino-6-p-(p-diethylaminophenyl)aminoanilinofluorane, 2-phenyl-6-p-(p-phenylaminophenyl-)aminoanilinofluorane, 2-benzyl-6-p-(p-phenylaminophenyl)aminoanilinofluorane, 2-hydroxy-6-p-(p-phenylaminophenyl)aminoanilinofluorane, 3-methyl-6-p-(p-dimethylaminophenyl)aminoanilinofluorane, 3-diethylamino-6-p (p-diethylaminophenyl)aminoanilinofluorane, 3-diethylamino-6-p-(pdibuthylaminophenyl-)aminoanilinofluorane, 3-methyl-7-p-(p-dimethylaminophenyl)aminoanilinofluorane, 3-methoxy7-p-(p-dimethylaminophenyl)aminoanilinofluorane, 3-chloro-7-p-(p-dimethylaminophenyl)aminoanilinofluorane, 3-nitro-7-p-(p-diethylaminophenyl)aminoanilinofluorane, 3-amino-7-p-(p-diethylaminophenyl)aminoanilinofluorane, 3-diethylamino 7-p (p-diethylaminophenyl) aminoanilinofluorane, 3-phenyl-7-p-(p-phenylaminophenyl) aminoanilinofluorane, 3 benzyl 7-p-(p-phenylaminophenyl) aminoanilinofluorane, 3-hydroxy-7-p-(p-phenylaminophenyl)aminoanilinofluorane, 2-methyl-7-p-(p-dimethylaminophenyl)aminoanilnofluorane, 2 diethylamino-7-p-(p-diethylaminophenyl) aminoanilinofluorane, 2-diethylamino-7-p-(p-dibutylaminophenyl)aminoanilinofluorane, 2-p-(p-dimethylaminophenyl)aminoanilino-6-methylfluorane, 2-p-(p-dimethylaminophenyl)aminoanilino-6-methoxyfluorane, 2-p-(p-dimethylaminophenyl)aminoanilino 6chlorofluorane, 2-p-(p-diethylaminophenyl-)aminoanilino6-nitrofluorane, 2-p-(p-diethylaminophenyl)aminoanilino6-aminofluorane, 2-p-(p-diethylaminophenyl)aminoanilino6-diethylaminofluorane, 2-p-(p-phenylaminophenyl) aminoanilino-6-phenylfluorane, 2-p-(p-phenylaminophenyl) aminoanilino-6-benzylfluorane, 2-p-(p-phenylaminophenyl) aminoanilino-6-hydroxyfluorane, 2-p-(p-dimethylaminophenyl-)aminoanilino-6-methylfluorane, 2-p-(p-diethylaminophenyl) aminoanilino-6diethylaminofluorane, 2 p-(p-phenylaminophenyl) aminoanilino 6 diethylaminofluorane, 3-p-(p-dimethylaminophenyl-)aminoanilino-7-methylfluorane, 3-p-(p-dimethylaminophenyl)aminoanilino 7 methoxyfluorane, 3-p-(p-dimethylaminophenyl)aminoanilino-7chlorofluorane, 3-p-(p-diethylaminophenyl)aminoanilino-7-nitrofluorane, 3-p-(p-diethylaminophenyl)aminoanilino7-aminofluorane, 3-p-(p-diethylaminophenyl)aminoanilino7-diethylaminofluorane, 3 p-(p-phenylaminophenyl) aminoanilino 7-phenylfluorane, 3-p-(p-phenylaminophenyl) aminoanilino 7-benzylfluorane, 3-p-(p-phenylaminophenyl) aminoanilino-7-hydroxyfluorane, 3-p-(p-dimethylaminophenyl)aminoanilino 7-methylfluorane, 3-p-(p-diethylaminophenyl-)aminoanilino-7diethylfluorane, and 3-p-(p-phenylaminophenyl) aminoanilino-7-diethylaminofluorane.

Taking the productivity, costs and performances into consideration, 2 methyl-6-p-(p-dimethylaminophenyl-)aminoanilinofluorane (m.p: 197–230° C.) of the following formula (V) and 2-chloro-3-methyl-6 p-(p-phenylaminophenyl)aminoanilinofluorane (m.p: 191.5–196° C.) of the following formula (VI) are most preferable.

-continued

| No. | $R_1$ | $R_2$ | $(X^1)_m$ | $(X^2)_n$ | $(X^3)_4$ |
|---|---|---|---|---|---|
| 6 | " | " | " | p-$CH_3$ | " |
| 7 | " | " | " | " | 5-Cl $(Br)_3$ |
| 8 | " | " | " | p-tert-$C_4H_9$ | $(Br)_4$ |
| 9 | " | " | " | m,p-$(OCH_3)_2$ | " |
| 10 | $C_2H_5$ | $C_2H_5$ | " | p-$OCH_3$ | " |
| 11 | " | " | " | p-$CH_3$ | " |
| 12 | " | " | m-$CH_3$ | p-$OCH_3$ | " |
| 13 | $C_4H_9$ | $C_4H_9$ | H | p-$OC_2H_5$ | " |
| 14 | $C_2H_5$ | iso-$C_5H_{11}$ | " | p-tert-$C_4H_9$ | " |
| 15 | $C_2H_5$ | 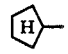 | " | p-$OCH_3$ | " |
| 16 | $CH_3$ | 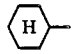 | " | " | " |
| 17 | $C_2H_5$ | 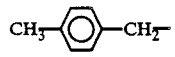 | m-$OCH_3$ | m,p-$(CH_3)_2$ | 5-Cl $(Br)_3$ |

Among the divinyl compounds of the general formula (II), 3,3-bis[2 (p-dimethylaminophenyl)-2-(p-methoxyphenyl)ethenyl]4,5,6,7-tetrabromorphthalide (m.p: 133–135° C.) and 3,3-bis[2-(p-dimethylaminophenyl)-2-(p-methoxyphenyl)ethenyl]4,5,6,7-tetrachlorophthalide (m.p: 133–135° C.) are most preferable, taking the productivity, costs and performances into consideration.

Among the fluorene-type leuco dyes cf the general

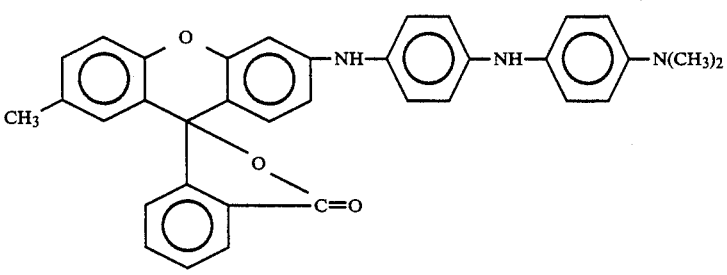

(V)

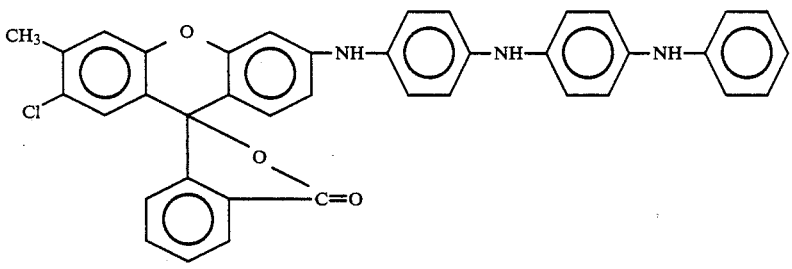

(VI)

The divinyl compounds of the general formula (II) are not particularly limited and include, for example, the following compounds:

| No. | $R_1$ | $R_2$ | $(X^1)_m$ | $(X^2)_n$ | $(X^3)_4$ |
|---|---|---|---|---|---|
| 1 | $CH_3$ | $CH_3$ | H | p-$OCH_3$ | $(Br)_4$ |
| 2 | " | " | " | " | 5-Cl $(Br)_3$ |
| 3 | " | " | " | p-$OC_4H_9$ | 5,6-$(Cl)_2$ $(Br)_2$ |
| 4 | " | " | " | p-$OC_6H_{13}$ | $(Br)_4$ |
| 5 | " | " | " | H | " |

formula (III), 3,6-bis dimethylamino)fluorene-9-spiro-3'-(6'-dimethylamino)phthalide is most preferable, taking the productivity, costs and performances into the consideration.

In the present invention, it is most suitable to use 0,1–25 parts by weight of fluorene-type leuco dye and 0,05–3 parts by weight of fluorane-type leuco dye, per 1 part by weight of divinyl compound.

The preferable organic color-developing agent of this invention are: bisphenols A, 4-hydroxybenzoic acid esters, 4-hydroxyphthalic acid diesters, phthalic acid monoesters, bis-(hydroxyphenyl)sulfides, 4-hydroxyphenyl arylsulfonate, 4-hydroxyphenyl arylsulfones, 1,3-di[2-(hydroxyphenyl)-2-propyl]benzenes, 4-hydroxybenzoyl oxybenzoic acid esters, bis-phenol sulfones and the like. Examples of these color-developing agents are as follows:

BISPHENOLS 4,4'-isopropylidenediphenoldiphenols (bisphenol A) 4,4'-cyclohexylidenediphenol p,p'-(1-methyl-normalhexylidene)diphenol 1,7-di(4-hydroxyphenylthio)-3,5-dioxaheptane 4-hydroxybenzoic acid esters 4-hydroxybenzoic acid benzyl ester 4-hydroxybenzoic acid ethyl ester 4-hydroxybenzoic acid propyl ester 4-hydroxybenzoic acid isopropyl ester 4-hydroxybenzoic acid butyl ester 4-hydroxybenzoic acid isobutyl ester 4-hydroxybenzoic acid methylbenzyl ester 4-hydroxyphthalic acid diesters 4-hydroxyphthalic acid dimethyl ester 4-hydroxyphthalic acid diisopropyl ester
4-hydroxyphthalic acid dibenzyl ester
4-hydroxyphthalic acid dihexyl ester Phthalic acid monoesters Phthalic acid monobenzyl ester
Phthalic acid monocyclohexyl ester
Phthalic acid monophenyl ester
Phthalic acid monomethylphenyl ester
Phthalic acid monoethylphenyl ester
Phthalic acid monoalkylbenzyl ester
Phthalic acid monohalogenebenzyl ester
Phthalic acid monoalkoxybenzyl ester Bis-(hydroxyphenyl)sulfides Bis-(4-hydroxy-3-tert-butyl-6-methylphenyl)sulfide
Bis-(4-hydroxy-2,5-dimethylphenyl)sulfide
Bis-(4-hydroxy-2-methyl-5-ethylphenyl)1)sulfide
Bis-(4-hydroxy-2-methyl-5-isopropylphenyl)sulfide
Bis-(4-hydroxy-2,3-dimethylphenyl)sulfide
Bis-(4-hydroxy-2,5diethylphenyl)sulfide
Bis-(4-hydroxy 2,5-diisopropylphenyl)sulfide
Bis-(4-hydroxy-2,3,6-trimethylphenylsulfide
Bis-(2,4,5-trihydroxyphenyl)sulfide
8is-(4-hydroxy-2-cyclohexyl-5-methylphenyl)sulfide
Bis-(2,3,4-trihydroxyphenyl)sulfide
8is-(4,5-dihydroxy-2-tert-butylphenyl)sulfide
Bis-(4-hydroxy-2,5-diphenylphenyl)sulfide
Bis-(4-hydroxy-2-tert-octyl-5-methylphenyl)sulfide 4-hydroxyphenylarylsulfones 4-hydroxy-4'-isopropoxydiphenyl sulfone
4-hydroxy-4'-methyldiphenyl sulfone
4-hydroxy-4'-n-butyloxydiphenyl sulfone
4-hydroxy phenylarylsulfonates
4-hydroxyphenylbenzene sulfonate
4-hydroxyphenyl-p-tolyl sulfonate
4-hydroxyphenyl methylene sulfonate
4-hydroxyphenyl-p-chlorobenzene sulfonate
4-hydroxyphenyl-p-tert-butylbenzene sulfonate
4-hydroxyphenyl-p-isopropoxybenzene sulfonate
4-hydroxyphenyl-1'-naphthaline sulfonate
4-hydroxyphenyl-2'-naphthaline sulfonate 1,3-di[2-(hydroxyphenyl)-2-propyl]-benzenes 1,3-di[2-(4-hydroxyphenyl)-2-propyl]-benzene
1,3-di[2-(4-hydroxy-3-alkylphenyl)-2-propyl]-benzene
1,3-di[2-(2,4 dihydroxyphenyl)-2-propyl]benzene
1,3 di[2 hydroxy-5-methylphenyl)-2-propyl]-benzene Resorcinoles 1,3-dihydroxy-6(α,αdimethylbenzyl)-benzene

4-HYDROXY BENZOYLOXYBENZOIC ACID ESTERS 4-hydroxybenzoyloxybenzoic acid benzyl ester
4-hydroxybenzoyloxybenzoic acid methyl ester
4-hydroxybenzoyloxybenzoic acid ethyl ester
4-hydroxybenzoyloxybenzoic acid propyl ester
4hydroxybenzoyloxybenzoic acid butyl ester
4-hydroxybenzoyloxybenzoic acid isopropyl ester
4-hydroxybenzoyloxybenzoic acid tert.-butyl ester
4-hydroxybenzoyloxybenzoic acid hexyl ester
4-hydroxybenzoyloxybenzoic acid octyl ester
4-hydroxybenzoyloxybenzoic acid nonyl ester
4hydroxybenzoyloxybenzoic acid cyclohexyl ester
4hydroxybenzoyloxybenzoic acid β-phenethyl ester
4-hydroxybenzoyloxybenzoic acid phenyl ester
4-hydroxybenzoyloxybenzoic acid α-naphthyl ester
4-hydroxybenzoyloxybenzoic acid β-naphthyl ester
4-hydroxybenzoyloxybenzoic acid sec-butyl ester

BISPHENOL-SULFONES (I)

Bis-(3–1-butyl-4-hydroxy-6-methylphenyl)sulfone
Bis-(3-ethyl-4-hydroxy phenyl)sulfone
Bis-(3-propyl-4-hydroxyphenyl)sulfone
Bis-(3-methyl-4-hydroxyphenyl)sulfone
Bis-(2-isopropyl-4-hydroxyphenyl)sulfone
Bis-(2-ethyl-4-hydroxyphenyl)sulfone
Bis-(3-chloro-4-hydroxyphenyl)sulfone
Bis-(2,3-dimethyl-4-hydroxyphenyl)sulfone
Bis-(2,5-dimethyl-4-hydroxyphenyl)sulfone
Bis-(3-methoxy-4-hydroxyphenyl)sulfone
4-hydroxyphenyl-2'-ethyl-4'-hydroxyphenylsulfone
4-hydroxyphenyl-2'-isopropyl-4'-hydroxyphenylsulfone
4-hydroxyphenyl-3'-isopropyl-4'-hydroxyphenylsulfone
4-hydroxyphenyl-3'-sec-butyl-4'-hydroxyphenylsulfone
3-chloro-4-hydroxyphenyl-3'-isopropyl4'-hydroxyphenylsulfone
4hydroxy-5-t butylphenyl 4'-hydroxyphenylsulfone
2hydroxy-5-t-amynophenyl-4,-hydroxyphenylsulfone
2hydroxy-5-isopropylphenyl-4'-hydroxyphenylsulfone
2hydroxy-5-t octylphenyl-4'-hydroxyphenylsulfone
2hydroxy-5-t-butylphenyl 3'-chloro-4'-hydroxyphenylsulfone
2hydroxy-5-t-butylphenyl-3'-methyl-4'-hydroxyphenylsulfone
2hydroxy-5-t butylphenyl-3'-isopropyl-4'-hydroxyphenylsulfone
2hydroxy-5-t-butylphenyl-3'-chloro-4'-hydroxyphenylsulfone
2hydroxy 5-t-butylphenyl 3'-methyl-4'-hydroxyphenylsulfone
2hydroxy-5-t-butylphenyl-3'-isopropyl-4'-hydroxyphenylsulfone
2hydroxy-5-t-butylphenyl-2'-methyl-4'-hydroxyphenylsulfone

BISPHENOLSULFONES (II)

4,4'-sulfonyldiphenol
2,4'-sulfonyldiphenol
3,3,-dichloro-4,4'-sulfonyldiphenol
3,3'-dibromo-4,4'-sulfonyldiphenol
3,3',5,5'-tetrabromo-4,4'-sulfonyldiphenol 3,3'diamino 4,4'-sulfonyldiphenol

OTHERS p-tert-butylphenol
2,4-hydroxybenzophenone
Novolac-phenolic resin
4 hydroxyacetophenone
p-phenylphenol
benzyl-4 hydroxyphenyl acetate
p-benzylphenol The above color developing agents may be used either alone or in combination.

In order to further improve light resistance, weather resistance, oil resistance etc., various polyvalent metal salts of organic acid may be used as stabilizer.

Among these stabilizers, halogen-substituted zinc benzoate derivatives represented by the following general formula (VII) are most preferable.

(VII)

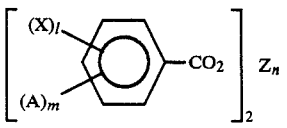

wherein

X represents a halogen atom; A represents a hydrogen atom, a nitro group, a $C_1$–$C_{12}$ alkyl group, a $C_1$–$C_{12}$ alkoxy group, a $C_3$–$C_{10}$ cycloalkyl group, a cyano group or a hydroxy group;

l represents 1 or 2; and m represents an integer from 0 to 5

In the general formula (VII), the "$C_1$–$C_{12}$ alkyl group" and "$C_1$–$C_{12}$ alkoxy group" may be linear or branched, and include, for example, methyl, ethyl, n-propyl, isopropyl, n-butyl, iso-butyl, sec-butyl, hexyl, octyl, nonyl, dodecyl, methoxy, ethoxy, tert-butoxy, and the like. The $C_3$–$C_{10}$ cycloalkyl group includes, for example, cyclohexyl, 2-ethylcyclohexyl, p-tertbutylcyclohexyl, and the like.

The above stabilizer of this invention is a compound having a particular molecular-structure selected from many organic carboxylic acid metal salts. The benzoic acid zinc salts having 1–2 halogen substituents on the benzene ring have excellent light-, weather-and oil resistances, which are not seen in similar free organic carboxylic acids or their polyvalent-metal salts.

Typical examples of the halogen-substituted zinc benzoate derivatives used in this invention are shown below. It should be understood, however, that they are merely illustrative, and the scope of this invention is not limited thereby.

(1)

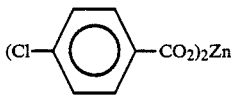

(2)

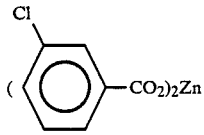

-continued (3)

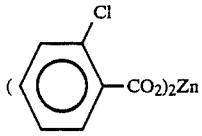

(4)

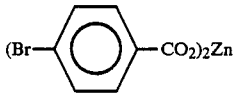

(5)

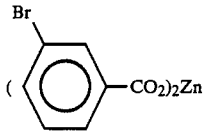

(6)

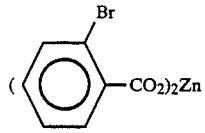

(7)

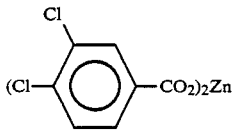

(8)

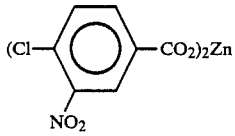

(9)

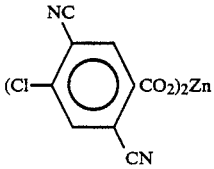

(10)

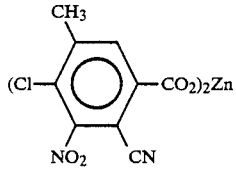

(11)

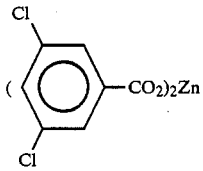

(12)

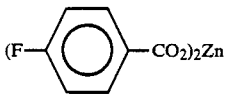

(13)

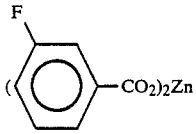

-continued (14)

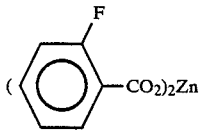

(15)

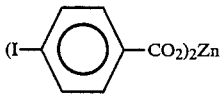

(16)

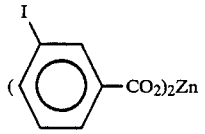

(17)

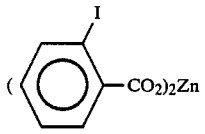

As sensitizer, there may be used fatty acid amide such as stearic acid amide, palmitic acid amide; ethylenebisamide; montan wax; polyethylene wax; dibenzyl terephthalate; benzyl p-benzyloxybenzoate; di-p-tolyl carbonate; p-benzylbiphenyl, phenyl α-naphthylcarbonate; 1,4-diethoxynaphthalene; 1 hydroxy-2-naphthoic acid phenyl ester; and the like.

As the binders of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyral-modified polyvinyl alcohol, other modified polyvinyl alcohol, hydroxyethyl cellulose, methyl cellulose, carboxymethyl cellulose, styrene/malic acid anhydride copolymers, styrene/butadiene copolymers, cellulose derivatives such as ethyl cellulose, acetyl cellulose, etc.; polyvinyl chloride, polyvinyl acetate, polyacryl amide, polyacrylic acid ester, polyvinyl butyrol, polystyrol and copolymers thereof; polyamide resin, silicone resin, petroleum resin, terpene resin, ketone resin and cumaron resin.

These polymeric materials may be used after they were dissolved in an solvent such as water, alcohol, ketone, ester hydrocarbon, etc., or after they were emulsified or dispersed in water or a solvent other than water.

The species and the amount of organic colordeveloping agent, colorless basic chromogenic dye and other ingredients, which are used in this invention, are determined depending upon the performance and recording aptitude required for the recording material, and are not otherwise limited. However, in ordinary cases, it is suitable to use 1–8 parts by weight of organic color developing agent, and 1–20 parts by weight of filler, based on 1 part by weight of colorless basic chromogenic dye, and to add 10–25 parts by weight of a binder in total solid content.

The aimed heat-sensitive recording material may be obtained by coating the above coating composition on a substrate such as paper, synthetic paper, film, etc.

The above organic color-developing agent, the above colorless basic chromogenic dye, and if necessary, other ingredients are ground to a particle size of several microns or smaller by means of a grinder or emulsifier such as a ball mill, attritor, sand grinder, etc., and binders and various additives in accordance with the purpose, are added thereto to prepare coating color. Such additives are as follows: filler; releasing agent for prevention of sticking, such as fatty acid metal salt; antifogging agent such as fatty acid amide, ethylenebisamide, montan wax, polyethylene wax etc.; dispersant such as sodium dioctylsulfosuccinate, sodium dodecylbenzene sulfonate, sodium laury alcohol sulfate, sodium alginate; UV-absorber such as benzophenone type or triazole type; antifoamer; fluorescent brightening agent; water resistance agent; and so on.

As filler, there may be used any organic or inorganic filler usually used in the paper-manufacturing field. Examples for fillers of this invention include clay, talc, silica, magnesium carbonate, alumina, aluminum hydroxide, magnesium hydroxide, barium sulfate, kaolin, titanium dioxide, zinc oxide, calcium carbonate, aluminum oxide, urea-formalin resin, polystyrene resin, phenol resin, etc.

The reason why the heat-sensitive recording sheet of this invention provides a superior optical readability in the near infrared region is thought as follows. The colored image in using electron-donating color-former such as conventional fluorane-type leuco dyes does not absorb the light of near infrared region. However, the fluorane-type leuco dyes of the general formula (I) or the divinyl compounds of the general formula (II) and optionally the fluorene-type leuco dyes of the general formula (III), absorb the light of near infrared region (specifically the near infrared region of 700–1500 nm) efficiently in a heat-melt reaction with an electron acceptor (color-developing agent).

The reason why the recorded image of a heat-sensitive recording material of this invention is excellent in light-resistance, weather-resistance and oil resistance is explained as follows. Generally, a heat-sensitive recording material is composed of colorless basic dye as electron donor an of organic acidic material, such as phenolic material, aromatic carboxylic acid, organic sulfonic acid, etc. as electron acceptor. The heat-melt reaction between a colorless basic dye and a color-developing agent is an acid-base reaction based on donating-acceptance of electron, whereby a pseudo-stable "electron charge transfer complex" is produced, which forms color.

On the other hand, the chemical binding force in the above reaction between the divinyl compound of this invention or the fluorine-type leuco dye or the fluorene-type leuco dye and the organic developing agent is very weak.

However, the combined use of the fluorane-type leuco dye and the divinyl compound and optionally the fluorene type leuco dye produces a synergism in the heat-melt reaction, which causes a prominent increase of chemical bonding force between an organic color-developing agent and each of the fluorane-type leuco dye, the divinyl compound and the fluorene-type leuco dye. Hence, it seems that the chemical bondings do not deteriorate for a long period even under the circumstance of light, heat, humidity, etc., so that a recorded image is remarkably stable, which does not lower the optical readability of the recorded image in the near infrared region.

The reason for a superior thermal responsibility in this invention is as follows. The combined use of fluorane-type leuco dye and the divinyl compound and optionally the fluorene-type leuco dye causes a melting-point depression in the heat-melt reaction, which increases a color-developing sensitivity.

(EXAMPLES)

The following examples illustrate this invention, although this invention is not limited to examples. The parts are parts by weight.

Example 1 (Test Nos. 1–6)

| | |
|---|---|
| Liquid A (dispersion of color-developing agent) | |
| Color-developing agent (see Table 1) | 6.0 parts |
| 10% aqueous solution of polyvinyl alcohol | 18.8 parts |
| Water | 11.2 parts |
| Liquid B (dye dispersion 1) | |
| Divinyl compound (see Table 1) | 1.0 part |
| 10% aqueous solution of polyvinyl alcohol | 2.3 parts |
| Water | 1.3 parts |
| Liquid C (dye dispersion 2) | |
| Fluorane-type leuco dye | 1.0 part |
| 10% aqueous solution of polyvinyl alcohol | 2.3 parts |
| Water | 1.3 parts |

Each liquid of the above-mentioned composition was ground to an average particle size of 1 micron by an attritor. Then, the dispersions were mixed in the following portion to prepare a coating color.

| Coating color | |
|---|---|
| Liquid A (dispersion of color-developing agent) | 36 parts |
| Liquid B (dye dispersion 1) | 4.6 parts |
| Liquid C (dye dispersion 2) | 4.6 parts |
| Kaolin clay (50% aqueous dispersion) | 12 parts |

The coating color was applied on one side of a base paper weighing 50 g/m$^2$ at a coating weight of 6.0 g/m$^2$ and then dried. The resultant paper was treated to a smoothness of 200–600 seconds by a supercalender. In this manner, a heat-sensitive recording sheet was obtained.

COMPARATIVE EXAMPLE 1 (TEST NOS. 7–8)

A heat-sensitive recording sheet was obtained in the same manner as in Example 1 except that Liquid C (dye dispersion 2) is not used.

COMPARATIVE EXAMPLE 2 (TEST NO. 9)

A heat-sensitive recording sheet was obtained in the same manner as in Example 1 except that Liquid B (dye dispersion 1) is not used.

With regard to the heat-sensitive recording sheets of Example No. 1 and Comparative Examples Nos. 1 and 2, the test results are shown in Tables 1 and 2.

TABLE 1

Test Results

| | Test No. | Color-developing agent | Divinyl compound | Fluorane-type leuco dye | Image density Static (1) | Image density Dynamic (2) |
|---|---|---|---|---|---|---|
| Example 1 | 1 | 4,4'-Isopropylidenediphenol | 3,3-Bis[2-(p-dimethylaminophenyl)-2-(p-methoxyphenyl)ethenyl-4,5,6,7-tetrachlorophthalide | 2-Chloro-3-methyl-6-p-(p-phenylaminophenyl) aminoanilinofluorane | 1.50 | 1.18 |
| | 2 | 4,4'-Isopropylidenediphenol | 3,3-Bis[2-(p-dimethylaminophenyl)-2-(p-methoxyphenyl)ethenyl-4,5,6,7-tetrabromophthalide | 2-Chloro-3-methyl-6-p-(p-phenylaminophenyl) aminoanilinofluorane | 1.48 | 1.19 |
| | 3 | 1,7-Di(4-hydroxyphenylthio)-3,5-dioxaheptane | 3,3-Bis[2-(p-dimethylaminophenyl)-2-(p-methoxyphenyl)ethenyl-4,5,6,7-tetrachlorophthalide | 2-Methyl-6-p-(p-dimethylaminophenyl) aminoanilinofluorane | 1.50 | 1.18 |
| | 4 | 1,8-Di(4-hydroxyphenylthio)-3,6-dioxaoctane | 3,3-Bis[2-(p-dimethylaminophenyl)-2-(p-methoxyphenyl)ethenyl)-4,5,6,7-tetrabromophthalide | 2-Methyl-6-p-(p-dimethylaminophenyl) aminoanilinofluorane | 1.49 | 1.19 |
| | 5 | 4-Hydroxy-4'-isopropoxydiphenyl sulfone | 3,3-Bis[2-(p-dimethylaminophenyl)-2-(p-methoxyphenyl)ethenyl-4,5,6,7-tetrachlorophthalide | 2-Chloro-3-methyl-6-p-(p-phenylaminophenyl) aminoanilinofluorane | 1.48 | 1.18 |
| | 6 | 4-Hydroxy-4'-isopropoxydiphenyl sulfone | 3,3-Bis[2-(p-dimethylaminophenyl)-2-(p-methoxyphenyl)ethenyl-4,5,6,7-tetrabromophthalide | 2-Chloro-3-methyl-6-p-(p-phenylaminophenyl) aminoanilinofluorane | 1.50 | 1.19 |
| Comparative Example 1 | 7 | 4,4'-Isopropylidenediphenol | 3,3-Bis[2-(p-dimethylaminophenyl)-2-(p-methoxyphenyl)ethenyl-4,5,6,7-tetrachlorophthalide | — | 1.11 | 1.03 |
| | 8 | 1,7-Di(4-hydroxyphenylthio)-3,5-dioxaheptane | 3,3-Bis[2-(p-dimethylaminophenyl)-2-(p-methoxyphenyl)ethenyl-4,5,6,7-tetrachlorophthalide | — | 1.10 | 1.01 |
| Comparative Example 2 | 9 | 4-Hydroxy-4'-Isopropoxydiphenyl sulfone | — | 2-Chloro-3-methyl-6-p-(p-phenylaminophenyl) aminoanilinofluorane | 1.11 | 1.00 |

TABLE 2

Test Results

| | Test No. | Infrared reflectance (%) (3) | Light resistance (4) Before treatment | Light resistance (4) After treatment | Light resistance (4) Percent residue (%) | Light resistance (4) Infrared reflectance (%) | Oil resistance (5) Before treatment | Oil resistance (5) After treatment | Oil resistance (5) Percent residue (%) | Oil resistance (5) Infrared reflectance (%) | Weather resistance (6) Before treatment | Weather resistance (6) After treatment | Weather resistance (6) Percent residue (%) | Weather resistance (6) Infrared reflectance (%) |
|---|---|---|---|---|---|---|---|---|---|---|---|---|---|---|
| Example 1 | 1 | 11 | 1.18 | 1.07 | 91 | 24 | 1.18 | 1.16 | 98 | 14 | 1.18 | 1.00 | 85 | 27 |
| | 2 | 12 | 1.19 | 1.09 | 92 | 27 | 1.19 | 1.16 | 97 | 15 | 1.19 | 1.02 | 86 | 29 |

TABLE 2-continued

| | Test No. | Infrared reflectance (%) (3) | Test Results: Light resistance (4) Before treatment | After treatment | Percent residue (%) | Infrared reflectance (%) | Oil resistance (5) Before treatment | After treatment | Percent residue (%) | Infrared reflectance (%) | Weather resistance (6) Before treatment | After treatment | Percent residue (%) | Infrared reflectance (%) |
|---|---|---|---|---|---|---|---|---|---|---|---|---|---|---|
| | 3 | 11 | 1.18 | 1.08 | 92 | 24 | 1.18 | 1.14 | 97 | 15 | 1.18 | 1.02 | 86 | 27 |
| | 4 | 12 | 1.19 | 1.08 | 91 | 26 | 1.19 | 1.17 | 98 | 15 | 1.19 | 1.02 | 86 | 28 |
| | 5 | 11 | 1.18 | 1.06 | 90 | 25 | 1.18 | 1.16 | 98 | 15 | 1.18 | 1.00 | 85 | 27 |
| | 6 | 11 | 1.19 | 1.09 | 92 | 25 | 1.19 | 1.15 | 97 | 13 | 1.19 | 1.03 | 87 | 28 |
| Comparative | 7 | 17 | 1.03 | 0.62 | 60 | 71 | 1.03 | 0.50 | 49 | 80 | 1.03 | 0.41 | 40 | 91 |
| Example 1 | 8 | 18 | 1.01 | 0.61 | 60 | 72 | 1.01 | 0.49 | 49 | 81 | 1.01 | 0.39 | 39 | 90 |
| Comparative Example 2 | 9 | 20 | 1.00 | 0.60 | 60 | 71 | 1.00 | 0.48 | 48 | 86 | 1.00 | 0.38 | 38 | 92 |

Notes (1) Static image density

A heat-sensitive recording sheet is pressed down for 5 seconds under pressure of 10 kg/cm$^2$ on a hot plate heated at 135° C., and the optical density is measured by a Macbeth densitometer (RD-914, using amber filter which is used in other samples).

(2) Dynamic image density

A heat-sensitive recording sheet is recorded with an impressed voltage of 18.03 Volt and a pulse width of 3.2 milli-seconds by using the thermal facsimile KB-4800 manufactured by TOSHIBA CORPORATION, and the optical density of the recorded image is measured by a Macbeth densitometer.

(3) Reflectance of infrared ray

The recorded image printed in Note (2) is measured by a spectrophotometer (using a wave length of 1000 nm).

(4) Light resistance

The image density obtained in Note (2) is defined as image density before light treatment. The recorded image is subjected to irradiation by light for 4 hours using a fade-O-meter, and then the image density (after light treatment) is measured. Residual rate is calculated from the following equation.

$$\text{Residual rate} = \frac{\text{Image density after light treatment}}{\text{Image density before light treatment}} \times 100\ (\%)$$

And the reflectance of infrared red ray is measured with respect to the recorded image after light irradiation. (5) Oil resistance The image density obtained in Note (2) is defined as image density before oil treatment. A drop of castor oil is applied on the recorded image, and washed off with filter paper after 10 sec. The obtained paper allows to stand for 24 hours at room temperature, and image density after oil treatment is measured. Residual rate is calculated from the following equation.

$$\text{Residual rate} = \frac{\text{Image density after oil treatment}}{\text{Image density before oil treatment}} \times 100\ (\%)$$

And the reflectance of infrared ray is measured with respect to the recorded image after oil treatment. (6) Weather resistance The image density obtained in Note (2) is defined as image density before treatment. The recorded image allows to stand for 24 hours under the conditions of 40° C. and 90% RH, and then the image density is measured by Macbeth densitometer.

$$\text{Residual rate} = \frac{\text{Image density after treatment}}{\text{Image density before treatment}} \times 100\ (\%)$$

And the reflectance of infrared ray is measured by spectrophotometer (using a wave length of 1000 nm) with respect to the recorded image after treatment.

EXAMPLE 2 (TEST. NOS. 11–13)

| | |
|---|---|
| Liquid A (dispersion of color-developing agent) | |
| Color-developing agent (see Table 3) | 6.0 parts |
| 10% aqueous solution of polyvinyl alcohol | 18.8 parts |
| Water | 11.2 parts |
| Liquid B (dye dispersion 1) | |
| Fluorane-type leuco dye (see Table 3) | 0.3 part |
| 10% aqueous solution of polyvinyl alcohol | 0.7 part |
| Water | 0.4 part |
| Liquid C (dye dispersion 2) | |
| Divinyl compound (see Table 3) | 1.0 part |
| 10% aqueous solution of polyvinyl alcohol | 2.3 parts |
| Water | 1.3 parts |
| Liquid D (dye dispersion 3) | |
| Fluorane-type leuco dye (see Table 3) | 1.0 part |
| 10% aqueous solution of polyvinyl alcohol | 2.3 parts |
| Water | 1.3 parts |

Each liquid of the above-mentioned composition was ground to an average particle size of 1 micron by an attritor. Then, the dispersions were mixed in the following portion to prepare a coating color.

| Coating color | |
|---|---|
| Liquid A (dispersion of color-developing agent) | 36 parts |
| Liquid B (dye dispersion 1) | 1.4 parts |
| Liquid C (dye dispersion 2) | 4.6 parts |
| Liquid D (dye dispersion 3) | 4.6 parts |
| Kaolin clay (50% aqueous dispersion) | 12 parts |

The coating color was applied on one side of a base paper weighing 50 g/m$^2$ at a coating weight of 6.0 g/m$^2$ and then dried. The resultant paper was treated to a smoothness of 200–600 seconds by a supercalender. In this manner, a heat-sensitive recording sheet was obtained.

COMPARATIVE EXAMPLE 3 (Test No. 14–16)

| | |
|---|---|
| Liquid A (dispersion of color-developing agent) | |
| Color-developing agent (see Table 3) | 6.0 parts |
| 10% aqueous solution of polyvinyl alcohol | 18.8 parts |
| Water | 11.2 parts |
| Liquid D (dye dispersion) | |
| Colorless basic dye (see Table 3) | 2.0 parts |
| 10% aqueous solution of polyvinyl alcohol | 4.6 parts |
| Water | 2.6 parts |

Each liquid of the above-mentioned composition was ground to an average particle size of 1 micron by an attritor. Then, the dispersions were mixed in the following portion to prepare a coating color.

| Coating color | |
|---|---|
| Liquid A (dispersion of color-developing agent) | 36 parts |
| Liquid D (dye dispersion) | 9.2 parts |
| Kaolin clay (50% aqueous dispersion) | 12 parts |

The coating color was applied on one side of a base paper weighing 50 g/m$^2$ at a coating weight of 6.0 g/m$^2$ and then dried. The resultant paper was treated to a smoothness of 200–600 seconds by a supercalender. In this manner, a heat-sensitive recording sheet was obtained.

COMPARATIVE EXAMPLE 4 (TEST. NOS. 17–19)

-continued

| | |
|---|---|
| Color-developing agent (see Table 3) | 6.0 parts |
| 10% aqueous solution of polyvinyl alcohol | 18.8 parts |
| Water | 11.2 parts |
| Liquid E (dye dispersion 1) | |
| Colorless basic dye (see Table 3) | 1.0 part |
| 10% aqueous solution of polyvinyl alcohol | 2.3 parts |
| Water | 1.3 parts |
| Liquid F (dye dispersion 2) | |
| Colorless basic dye (see Table 3) | 1.0 part |
| 10% aqueous solution of polyvinyl alcohol | 2.3 parts |
| Water | 1.3 parts |

Each liquid of the above-mentioned composition was ground to an average particle size of 1 micron by an attritor. Then, the dispersions were mixed in the following portion to prepare a coating color.

| Coating color | |
|---|---|
| Liquid A (dispersion of color-developing agent) | 36 parts |
| Liquid E (dye dispersion 1) | 4.6 parts |
| Liquid F (dye dispersion 2) | 4.6 parts |
| Kaolin clay (50% aqueous dispersion) | 12 parts |

The coating color was applied on one side of a base paper weighing 50 g/m$^2$ at a coating weight of 6.0 g/m$^2$ and then dried. The resultant paper was treated to a smoothness of 200–600 seconds by a supercalender. In this manner, a heat-sensitive recording sheet was obtained.

With regard to the heat-sensitive recording sheets of Example No. 2 and Comparative Examples Nos. 3 and 4, the test results are shown in Tables 3 and 4.

TABLE 3

| | Test No. | Color-developing agent | Fluorane-type leuco dye | Divinyl compound | Fluorene-type leuco dye |
|---|---|---|---|---|---|
| | | | Test Results | | |
| Example 2 | 11 | 4,4'-Isopropylidene-diphenol | 2-Chloro-3-methyl-6-p-(p-phenylaminophenyl) aminoanilinofluorane | 3,3-Bis[2-(p-dimethylaminophenyl)-2-(p-methoxyphenyl)ethenyl]-4,5,6,7-tetrabromophthalide | 3,6-Bis(dimethylamino) fluorene-9-spiro-3'-(6'-dimethylamino)phthalide |
| | 12 | 4,4'-Isopropylidene-diphenol | 2-Chloro-3-methyl-6-p-(p-phenylaminophenyl) aminoanilinofluorane | 3,3-Bis[2-(p-dimethylaminophenyl)-2-(p-methoxyphenyl)ethenyl]-4,5,6,7-tetrachlorophthalide | 3,6-Bis(dimethylamino) fluorene-9-spiro-3'-(6'-dimethylamino)phthalide |
| | 13 | 1,7-Di(4-hydroxy-phenylthio)-3,5-dioxaheptane | 2-Methyl-6-p-(p-dimethylaminophenyl) aminoanilinofluorane | 3,3-Bis[2-(p-dimethylaminophenyl)-2-(p-methoxyphenyl)ethenyl]-4,5,6,7-tetrachlorophthalide | 3,6-Bis(dimethylamino) fluorene-9-spiro-3'-(6'-dimethylamino)phthalide |
| Comparative Example 3 | 14 | 4,4'-Isopropylidene-diphenol | 2-Chloro-3-methyl-6-p-(p-phenylaminophenyl) aminoanilinofluorane | — | — |
| | 15 | 4,4'-Isopropylidene-diphenol | — | 3,3-Bis[2-(p-dimethylaminophenyl)-2-(p-methoxyphenyl)ethenyl]-4,5,6,7-tetrachlorophthalide | — |
| | 16 | 4,4'-Isopropylidene-diphenol | — | — | 3,6-Bis(dimethylamino) fluorene-9-spiro-3'-(6'-dimethylamino)phthalide |
| Comparative Example 4 | 17 | 4,4'-Isopropylidene-diphenol | — | 3,3-Bis[2-(p-dimethylaminophenyl)-2-(p-methoxyphenyl)ethenyl]-4,5,6,7-tetrachlorophthalide | 3,6-Bis(dimethylamino) fluorene-9-spiro-3'-(6'-dimethylamino)phthalide |
| | 18 | 4,4'-Isopropylidene-diphenol | 2-Chloro-3-methyl-6-p-(p-phenylaminophenyl) aminoanilinofluorane | — | 3,6-Bis(dimethylamino) fluorene-9-spiro-3'-(6'-dimethylamino)phthalide |
| | 19 | 4,4'-Isopropylidene-diphenol | 2-Chloro-3-methyl-6-p-(p-phenylaminophenyl) aminoanilinofluorane | 3,3-Bis[2-(p-dimethylaminophenyl)-2-(p-methoxyphenyl)ethenyl]-4,5,6,7-tetrachlorophthalide | — |

Liquid A (dispersion of color-developing agent)

TABLE 4

| | Test Results | | | | | | | | | |
|---|---|---|---|---|---|---|---|---|---|---|
| | Image density | | Light resistance (4) | | | | Oil resistance (5) | | | |
| | Dyna- | Infrared | Before | After | Percent | Infrared | Before | After | Percent | Infrared |

TABLE 4-continued

Test Results

| | Test No. | Static (1) | mic (2) | reflectance (%) | treat-ment | treat-ment | residue (%) | reflectance (%) | treat-ment | treat-ment | residue (%) | reflectance (%) |
|---|---|---|---|---|---|---|---|---|---|---|---|---|
| Example 2 | 11 | 1.48 | 1.19 | 11 | 1.19 | 1.09 | 92 | 27 | 1.19 | 1.16 | 97 | 15 |
| | 12 | 1.50 | 1.18 | 12 | 1.18 | 1.07 | 91 | 24 | 1.18 | 1.16 | 98 | 14 |
| | 13 | 1.50 | 1.18 | 11 | 1.18 | 1.08 | 92 | 24 | 1.18 | 1.16 | 98 | 15 |
| Comparative | 14 | 1.11 | 1.10 | 18 | 1.00 | 0.60 | 60 | 71 | 1.00 | 0.48 | 48 | 86 |
| Example 3 | 15 | 1.11 | 1.03 | 18 | 1.03 | 0.62 | 60 | 71 | 1.03 | 0.50 | 49 | 79 |
| | 16 | 1.08 | 1.00 | 20 | 1.00 | 0.60 | 60 | 70 | 1.00 | 0.47 | 47 | 85 |
| Comparative | 17 | 1.35 | 1.12 | 16 | 1.12 | 0.84 | 75 | 50 | 1.12 | 0.79 | 71 | 20 |
| Example 4 | 18 | 1.34 | 1.11 | 17 | 1.11 | 0.85 | 77 | 52 | 1.11 | 0.79 | 71 | 22 |
| | 19 | 1.35 | 1.13 | 16 | 1.13 | 0.90 | 80 | 55 | 1.13 | 0.84 | 74 | 25 |

| | | Image density | | | Weather resistance (6) | | | |
|---|---|---|---|---|---|---|---|---|
| | Test No. | Static (1) | Dyna-mic (2) | Infrared reflectance (%) | Before treat-ment | After treat-ment | Percent residue (%) | Infrared reflectance (%) |
| Example 2 | 11 | 1.48 | 1.19 | 11 | 1.19 | 1.02 | 86 | 29 |
| | 12 | 1.50 | 1.18 | 12 | 1.18 | 1.00 | 85 | 27 |
| | 13 | 1.50 | 1.18 | 11 | 1.18 | 1.02 | 86 | 27 |
| Comparative | 14 | 1.11 | 1.10 | 18 | 1.00 | 0.38 | 38 | 92 |
| Example 3 | 15 | 1.11 | 1.03 | 18 | 1.03 | 0.41 | 40 | 92 |
| | 16 | 1.08 | 1.00 | 20 | 1.00 | 0.37 | 37 | 91 |
| Comparative | 17 | 1.35 | 1.12 | 16 | 1.12 | 0.78 | 70 | 35 |
| Example 4 | 18 | 1.34 | 1.11 | 17 | 1.11 | 0.80 | 72 | 37 |
| | 19 | 1.35 | 1.13 | 16 | 1.13 | 0.80 | 71 | 36 |

(1) Static image density

A heat-sensitive recording sheet is pressed down for 5 seconds under pressure of 10 kg/cm$^2$ on a hot plate heated at 135° C., and the optical density is measured by a Macbeth densitometer (RD-914, using amber filter which is used in other samples).

(2) Dynamic image density

A heat-sensitive recording sheet is recorded with an impressed voltage of 16.00 Volt and a pulse width of 3.0 milli-seconds by using the thermal facsimile KB-4800 manufactured by TOSHIBA CORPORATION, and the optical density of the recorded image is measured by a Macbeth densitometer.

(3) Reflectance of infrared ray

The recorded image printed in Note (2) is measured by a spectrophotometer (using a wave length of 1000 nm).

(4) Light resistance

The image density obtained in Note (2) is defined as image density before light treatment. The recorded image is subjected to irradiation by light for 6 hours using a fade-O-meter, and then the image density (after light treatment) is measured. Residual rate is calculated from the following equation.

$$\text{Residual rate} = \frac{\text{Image density after light treatment}}{\text{Image density before light treatment}} \times 100\ (\%)$$

And the reflectance of infrared red ray is measured with respect to the recorded image after light irradiation.

(5) Oil resistance

The image density obtained in Note (2) is defined as image density before oil treatment. A drop of castor oil is applied on the recorded image, and wished off with filter paper after 10 sec. The obtained paper allows to stand for 72 hours at room temperature, and image density after oil treatment is measured. Residual rate is calculated from the following equation.

$$\text{Residual rate} = \frac{\text{Image density after oil treatment}}{\text{Image density before oil treatment}} \times 100\ (\%)$$

And the reflectance of infrared ray is measured with respect to the recorded image after oil treatment.

(6) Weather resistance

The image density obtained in Note (2) is defined as image density before treatment. The recorded image allows to stand for 8 hours under the conditions of 40° C. and 90% RH, and then the image density is measured by Macbeth densitometer.

$$\text{Residual rate} = \frac{\text{Image density after treatment}}{\text{Image density before treatment}} \times 100\ (\%)$$

And the reflectance of infrared ray is measured by spectrophotometer (using a wave length of 1000 nm) with respect to the recorded image after treatment.

We claim:

1. A heat-sensitive recording material comprising a support having thereon a color-developing layer which contains as a main ingredient a colorless or pale colored basic chromogenic dye and an organic color-developing agent, wherein said color-developing layer comprises as said colorless or pale colored basic chromogenic dey both a fluorane-type leuco dye represented by the following general formula (I) and a divinyl compound represented by the following general formula (II):

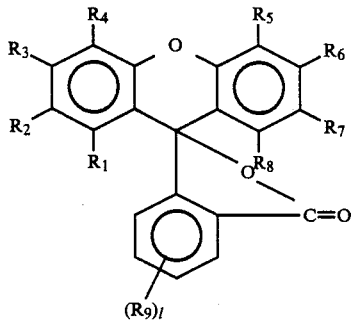

(I)

wherein at least one of $R_1$, $R_2$, $R_3$, $R_4$, $R_5$, $R_6$, $R_7$, $R_8$ and $R_9$ represents

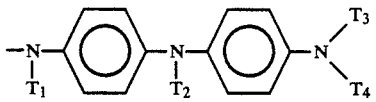

the remainders of $R_1$, $R_2$, $R_3$, $R_4R_5$, $R_6$, $R_7$, $R_8$ and $R_9$, which may be the same or different, represent a hydrogen atom, an alkyl group, an alkoxy group, a cycloalkyl group, a halogen atom, a nitro group, a hydroxy group, an amino group, a substituted amino group, an aralkyl group, a substituted aralkyl group, an aryl group or a substituted aryl group;

$T_1$, $T_2$ and $T_3$, which may be the same or different, represent a hydrogen atom, a $C_1$–$C_8$ alkyl group, a $C_3$–$C_9$ alkenyl group, or a $C_3$–$C_9$ alkinyl group;

$T_4$ represents a hydrogen atom, a $C_1$–$C_8$ alkyl group, a $C_3$–$C_9$ alkenyl group, a $C_3$–$C_9$ alkinyl group or a phenyl group; in addition, $T_3$ and $T_4$ taken together with the nitrogen to which they are attached, may represent, a morpholino group, a pyrrolidino group, a piperidino group or a hexamethyleneimino group; and l represents an integer from 0 to 4;

wherein $R_{10}$ represents an alkyl group of not more than 8 carbon atoms;

$R_{11}$ represents an alkyl group of not more than 8 carbon atoms, a $C_5$–$C_7$ cycloalkyl group, a benzyl group which may be substituted with a chlorine atom, a bromine atom and/or an alkyl group of not more than 4 carbon atoms; or a phenyl group which may be substituted with a chlorine atom, a bromine atom and/or an alkyl group of not more than 4 carbon atoms;

$X^1$ and $X^2$, which may be the same or different, represent an alkyl group of not more than 8 carbon atoms, an alkoxy group of not more than 8 carbon atoms, a fluorine atom, a chlorine atom or a bromine atom;

m and n each represents 0, 1, 2 or 3;

each $X^1$ of $(X^1)_n$, each $X^2$ of $(X^2)_n$ or each $X^3$ of $(X^3)_n$ can be the same or different; and $X^3$ represents a chlorine atom or a bromine atom.

2. The heat-sensitive recording material according to claim 1, wherein the fluorane-type leuco dye represented by the general formula (I) is at least one dye selected from the group consisting of 2-chloro3-methyl-6-p-(p-phenylaminophenyl)aminoanilinofluorane or 2-methyl-6-p-(p-dimethylaminophenyl )aminoanilinofluorane, and the divinyl compound represented by the general formula (II) is 3,3-bis[2-(p-dimethylaminophenyl)-2-(p-methoxyphenyl)ethenyl]-4,5,6,7-tetrabromophthalide or 3,3-bis[2-(p-dimethylaminophenyl-2-(p-methyoxyphenyl)ethenyl]-4,5,6,7-tetrachlorophthalide.

3. The heat-sensitive recording material according to claim 1, wherein the color-developing layer further comprises a fluorene-type leuco dye represented by the following general formula (III):

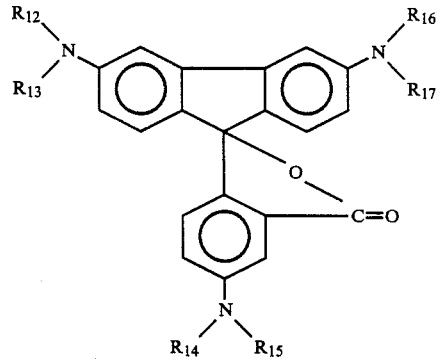

(III)

wherein $R_{12}$, $R_{13}$, $R_{14}$, R15, $R_{16}$ and $R_{17}$, which may be the same or different, represent a hydrogen atom; a $C_{1-C8}$ alkyl group; a $C_5$-$C_8$ cycloalkyl group; a $C_2$–$C_8$ alkoxyalkyl group; a $C_3$–$C_9$ unsaturated alkyl group; a tetrahydrofurfuryl group; a tetrahydropyran-2-methyl group; an alkyl group which is substituted by a halogen atom and/or a $C_1$–$C_4$ alkyl group an aryl group which may be substituted by a halogen atom, a $C_1$–$C_4$ alkyl group and/or a $C_1$–$C_4$ alkoxy group; a $C_2$–$C_8$ alkyl group having a phenoxy group which may be substituted by a halogen atom, a $C_1$-$C_4$ alkyl group and/or a $C_1$–$C_4$ alkoxy group; in addition, $R_{12}$ and $R_{13}$, $R_{14}$ and $R_{15}$, or $R_{16}$ and $R_{17}$ taken together with each other or with an attached benzene ring may form a heterocyclic ring.

4. The heat-sensitive recording material according to claim 3, wherein the fluorene leuco dye is 3,6-bis(dimethylamino)fluorene-9-spiro-3'-(6'-dimethylamino)phthalide.

5. The heat sensitive recording material according to claim 1, wherein the organic color-developing agent is at least one substance selected from the group consisting of bisphenol A, 4-hydroxybenzoic acid esters, 4-hydroxyphthalic acid diesters, phthalic acid monoesters, bis (hydroxyphenyl)sulfides, 4-hydroxyphenyl arylsulfonate, 4-hydroxyphenyl arylsulfones, 1,3-di[2-(hydroxyphenyl)-2-propyl]benzenes 4-hydroxybenzoyl oxybenzoic acid esters and bisphenol sulfones.

6. The heat-sensitive recording material according to claim 1, wherein the color-developing layer comprises 1–8 parts by weight of the organic color-developing agent and 1–20 parts by weight of filler, based on 1 part by weight of the colorless basic chromogenic dye, and 10–25 parts by weight of binder in total solid content.

7. The heat-sensitive recording material according to claim 1, wherein the support is at least one member selected from a group consisting of paper, synthetic paper and film.

8. The heat-sensitive recording material according to claim 1, wherein the color-developing layer further comprises as a stabilizer a polyvalent metal salt of organic acid.

* * * * *